US007985724B2

(12) United States Patent
Inoue et al.

(10) Patent No.: US 7,985,724 B2
(45) Date of Patent: Jul. 26, 2011

(54) DETERGENT COMPOSITION FOR HARD SURFACE

(75) Inventors: Takumi Inoue, Wakayama (JP); Junya Hanai, Wakayama (JP); Kazunori Tsukuda, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/303,222

(22) PCT Filed: Jul. 19, 2007

(86) PCT No.: PCT/JP2007/064627

§ 371 (c)(1),
(2), (4) Date: Feb. 5, 2009

(87) PCT Pub. No.: WO2008/010606

PCT Pub. Date: Jan. 24, 2008

(65) Prior Publication Data

US 2009/0197793 A1 Aug. 6, 2009

(30) Foreign Application Priority Data

Jul. 21, 2006 (JP) ..... 2006-199330

(51) Int. Cl.

| | |
|---|---|
| ***C11D 1/66*** | (2006.01) |
| ***C11D 1/75*** | (2006.01) |
| ***C11D 3/20*** | (2006.01) |
| ***C11D 3/43*** | (2006.01) |

(52) U.S. Cl. ..... 510/238; 510/422; 510/434; 510/470; 510/477; 510/488; 510/499; 510/503; 510/505; 510/506

(58) Field of Classification Search ..... 510/238, 510/421, 422, 423, 424, 426, 427, 433, 470, 510/477, 488, 499, 505, 506, 503
See application file for complete search history.

(56) References Cited

U.S. PATENT DOCUMENTS 6,232,283 B1 5/2001 Inoue et al.

FOREIGN PATENT DOCUMENTS

| | | | |
|---|---|---|---|
| EP | 0926231 | A1 | 6/1999 |
| EP | 1466960 | A1 | 10/2004 |
| JP | 4-91197 | A | 3/1992 |
| JP | 5-214392 | A | 8/1993 |
| JP | 5-214393 | A | 8/1993 |
| JP | 7-3289 | A | 1/1995 |
| JP | 11-189796 | A | 7/1999 |

OTHER PUBLICATIONS

Chinese Office Action for Application No. 200780027698.4, dated Aug. 4, 2010, with English translation.

*Primary Examiner* — Gregory R Del Cotto
(74) *Attorney, Agent, or Firm* — Birch, Stewart, Kolasch & Birch, LLP

(57) ABSTRACT

Disclosed is a detergent composition for hard surface, containing (A) a monoalkyl glyceryl ether whose alkyl group has 3 to 8 carbon atoms, (B) a specific compound represented by the formula (1), (C) an amine, (D) a polyvalent carboxylic acid having a molecular weight of 40 to 400 and/or a salt thereof, (E) a surfactant provided that (A) and (B) are excluded from (E), and water, wherein the mass ratio of (A)/(B), the content of (A)+(B), the mass ratio of (C)/(D), and the content of (C)+(D) are respectively in a specific range, and the pH of the detergent composition at 20° C. is 9.5 to 11.5.

1 Claim, No Drawings

DETERGENT COMPOSITION FOR HARD SURFACE

FIELD OF THE INVENTION

The present invention relates to a detergent composition for hard surface.

BACKGROUND OF THE INVENTION

Dirt on hard surfaces in a house, particularly dirt occurring around cooking appliances in a kitchen, is dirt based on cooking food-derived oil, and the oil particularly around on a stove burner is easily denatured because of its proximity to a heat source and is thus hardly removable. To remove such oil-derived denatured dirt, a strongly alkaline liquid detergent compounded with a solvent has been proposed. For example, JP-A 4-091197, JP-A 5-214392, and JP-A 5-214393 describe detergent compositions for hard surface which contain butyl carbitol (also called diethylene glycol monobutyl ether) with a suppressed solvent odor.

JP-A 11-189796 and JP-A 7-3289 describe detergent compositions for hard surface which are compounded with monoalkyl monoglyceryl ether, a surfactant and an alkali or a builder, and an amine compound is mentioned as the alkali and an organic acid salt is mentioned as the builder. In the detailed description of JP-A 7-3289, another organic solvent is mentioned as an arbitrary component and exemplified specifically by diethylene glycol monobutyl ether etc.

SUMMARY OF THE INVENTION

The present invention relates to a detergent composition for hard surface, containing:

(A) a monoalkyl glyceryl ether whose alkyl group has 3 to 8 carbon atoms [referred to hereinafter as component (A)], (B) a compound represented by the following formula (1) [referred to hereinafter as component (B)]:

$$R^1(OR^2)_mOH \quad (1)$$

wherein $R^1$ is a C2 to C6 alkyl group, m is a number of 1 to 4, and $R^2$ is a C2 or C3 alkylene group, (C) an amine [referred to hereinafter as component (C)]

(D) a polyvalent carboxylic acid having a molecular weight of 40 to 400 and/or a salt thereof [referred to hereinafter as component (D)], 0.1 to 5% by mass of (E) a surfactant [referred to hereinafter as component (E)] provided that (A) and (B) are excluded from (E), and water, wherein:

the mass ratio of (A) to (B), that is, (A)/(B) is 0.2 to 5, the total content of (A) and (B), that is, (A)+(B) is 1 to 15% by mass, the mass ratio of (C) to (D), that is, (C)/(D) is 5 to 30, the total content of (C) and (D), that is, (C)+(D) is 2 to 7% by mass provided that (D) is calculated as acid form, and the pH of the detergent composition at 20° C. is 9.5 to 11.5.

The invention provides use of the above shown composition as a detergent for hard surface.

DETAILED EXPLANATION OF THE INVENTION

Around a range in a kitchen, particularly in a stove burner and a grill, cleaning is structurally significantly troublesome. In addition, dirt derived from food materials, oils and fats is denatured by heating and solidified, thus making its removal difficult, as described above. Generally, highly alkaline detergents compounded with an organic solvent have been used for such dirt, but these detergents are hardly conveniently usable because of their pH, but when their pH is decreased, the detergents are made poor in detergency. In addition, higher cleanliness is recently demanded in living, and structurally easily cleanable ranges such as an induction heating cooker are becoming common, and thus there is a need for detergents for hard surface which are conveniently usable with suppressed alkalinity.

The present invention provides a detergent composition for hard surface, which has a high detergency and is excellent in usability with low pH. The present invention provides a detergent composition for hard surface, which has such pH as to be conveniently usable and shows an excellent detergency for tough denatured oily dirt etc.

According to the present invention, there can be provided a detergent composition for hard surface, which shows excellent detergency for tough denatured oily dirt etc., though having pH in such a range as to be lower and thus more conveniently usable than conventional detergents for cooking ranges. The detergent composition for hard surface in the present invention can be applied to cleaning of hard surfaces in a house, such as hard surfaces of a bathroom, kitchen accessories, some kitchen utensils (grill etc.), a floor, and a toilet and can be easily used at home particularly for cleaning of kitchen utensils such as a stove burner, a grill, a range etc.

<Component (A)>

The component (A) is a monoalkyl glyceryl ether whose alkyl group has 3 to 8 carbon atoms. This compound shows excellent detergency with less damaging influence on a base material. As disclosed in JP-A 11-189796, the component (A) in the present invention is a compound whose alkyl group has 3 to 8 carbon atoms, preferably 4 to 6 carbon atoms, more preferably 5 carbon atoms, from the viewpoint of detergency and liquid stability. The component (A) may be a mixture of compounds different from one another in the number of carbon atoms in the alkyl group and/or in the structure of the alkyl group and is particularly preferably a mixture of compounds having a linear or branched alkyl group having 4 to 6 carbon atoms, from the viewpoint of detergency.

The component (A) is produced generally by a method of reacting an alcohol with an epoxy compound such as epihalohydrin or glycidol in the presence of an acid catalyst such as $BF_3$ or an aluminum catalyst and is obtained as a mixture containing a plurality of products as described in JP-A 2001-49291. Examples of the component (A) include 3-(pentaneoxy)-1,2-propanediol that is a compound having pentanol added at the 1-position of an epoxy compound and 2-(pentaneoxy)-1,3-propanediol that is a compound having pentanol added at the 2-position of an epoxy compound. As byproducts, there are poly-addition compounds containing epoxy compounds further added to the above compounds. In the present invention, it is preferable to use a monoalkyl glyceryl ether wherein the content of such byproducts is 10% by mass or less, particularly preferably 1% by mass or less.

<Component (B)>

The component (B) is a compound represented by the following formula (1):

$$R(OR^2)_mOH \quad (1)$$

wherein $R^1$ is a C2 to C6 alkyl group, m is a number of 1 to 4, and $R^2$ is a C2 or C3 alkylene group.

When $R^1$ is a methyl group, the majority of components (B) have a high vapor pressure, thus making them to vaporize so easily that the solvent is removed during wiping, and sufficient detergency cannot be achieved. In the present invention, the vapor pressure of the component (B) at 20° C. is preferably less than 2 mmHg, more preferably 1 mmHg or less.

Specific examples of the component (B) include, for example, ethylene glycol monoethyl ether, ethylene glycol monopropyl ether, ethylene glycol monobutyl ether, diethylene glycol monoethyl ether, diethylene glycol monopropyl ether, diethylene glycol monobutyl ether, diethylene glycol monohexyl ether, propylene glycol monoethyl ether, propylene glycol monopropyl ether, propylene glycol monobutyl ether, propylene glycol monohexyl ether, dipropylene glycol monoethyl ether, dipropylene glycol monopropyl ether, dipropylene glycol monobutyl ether, and triethylene glycol monobutyl ether. Among these compounds, diethylene glycol monobutyl ether, dipropylene glycol monobutyl ether, triethylene glycol monobutyl ether, diethylene glycol monohexyl ether, monopropylene glycol monobutyl ether, particularly diethylene glycol monobutyl ether and dipropylene glycol monobutyl ether, are preferable as compounds that are excellent in detergency, inexpensive and excellent in usability. It is preferable to use diethylene glycol monobutyl ether with a suppressed solvent odor with a lower content of another solvent as shown in JP-A 4-091197, and it is preferable to use diethylene glycol monobutyl ether blended with an antioxidant in order to suppress odor generation due to storage.

In the present invention, the components (A) and (B) can be simultaneously used to achieve excellent detergency for dirt on hard surfaces.

<Component (C)>

In the present invention, the term "amine" as component (C) is meant an amine or ammonia. It is known that an amine, when incorporated into a liquid detergent, functions as an alkali. In the present invention, an amine selected from those of the following formulae (2) to (5) can be mentioned.

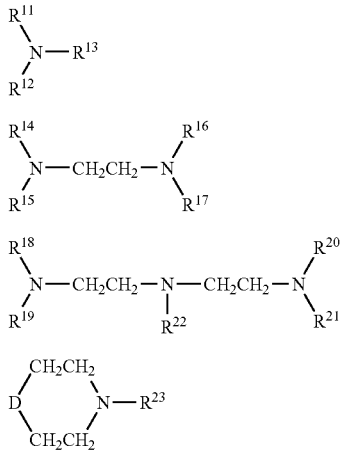

(2)

(3)

(4)

(5)

wherein $R^{11}$, $R^{14}$, $R^{16}$, $R^{18}$, $R^{20}$, $R^{22}$ and $R^{23}$ each represent a hydrogen atom or a C1 to C4 alkyl group, $R^{12}$, $R^{13}$, $R^{15}$, $R^{17}$, $R^{19}$ and $R^{21}$ each represent a hydrogen atom, a C1 to C4 alkyl group, or a C2 to hydroxyalkyl group, and D represents a C1 to C3 alkylene group or an oxygen atom.

The compound represented by the formula (2) includes ammonia, monoethanolamine, diethanolamine, triethanolamine, N-methylpropanolamine, 2-amino-2-methyl-1-propanol, etc. The compound represented by the formula (3) includes N-(β-aminoethyl)ethanolamine etc. The compound represented by the formula (4) includes diethylene triamine, etc. The compound represented by the formula (5) includes morpholine, N-ethylmorpholine, etc.

An even more preferable amine in the present invention is monoethanolamine, diethanolamine, triethanolamine, N-methylpropanolamine or ammonia, among which monoethanolamine is particularly preferable.

The component (C) when combined with a polyvalent carboxylic acid or a salt thereof as the component (D) described later can suppress a fluctuation, by an acid, in the pH of the detergent, and in consequence, the pH is not lowered by an acid derived from objective dirt, thus attaining excellent detergency at weakly alkaline pH.

<Component (D)>

The component (D) in the invention is a polyvalent carboxylic acid with a molecular weight of 40 to 400, preferably 90 to 360, more preferably 100 to 300, having 2 or more, preferably 2 to 6 carboxylic acid groups, in the molecule thereof, or a salt thereof. Specifically, the component (D) is preferably a carboxylic acid selected from formic acid, acetic acid, gluconic acid, malic acid, tartaric acid, lactic acid, citric acid, succinic acid, maleic acid and fumaric acid, an aminocarboxylic acid selected from ethylenediamine tetraacetic acid, diethylenetriamine pentaacetic acid, methylglycine diacetic acid, glutamate diacetic acid, serine diacetic acid, and aspartate diacetic acid, or a salt thereof, among which citric acid, succinic acid or ethylenediamine tetraacetic acid is preferable. The salt is compounded preferably as a sodium or potassium salt or may be a salt with the amine as the component (B).

<Component (E)>

The surfactant as the component (E) used in the present invention can include at least one kind of anionic surfactant, nonionic surfactant, amphoteric surfactant or cationic surfactant. Particularly, a nonionic surfactant and/or an amphoteric surfactant are preferably compounded for detergency and foaming property. In the present invention, the components (A) and (B) are excluded from the component (E).

The anionic surfactant is a surfactant having a linear or branched alkyl group or an alkyl group, and specific examples include alkyl benzene sulfonates, alkyl or alkenyl ether sulfates, alkyl or alkenyl sulfates, olefin sulfonates, alkane sulfonates, saturated or unsaturated fatty acid salts, alkyl or alkenyl ether carboxylates, α-sulfofatty acid salts, or esters thereof. As a salt of the anionic surfactant, it is possible to use an alkali metal salt, or in consideration of stability, an alkaline earth metal salt. The anionic surfactant may be compounded as acid to form a salt with an alkali as an arbitrary component described later, and may form a salt with the component (C) insofar as the pH requirement in the invention can be satisfied.

The nonionic surfactant can include polyoxyalkylene alkyl ethers, alkyl glycosides as represented by alkyl polyglucosides, fatty acid alkanol amides or alkylene oxide adducts thereof, sucrose fatty acid esters, fatty acid glycerin monoesters, Pluronic surfactants, and sorbitan fatty acid esters or ethylene oxide adducts.

The amphoteric surfactant can include alkylamine oxide, sulfobetaine, carbobetaine etc.

The cationic surfactant can include quaternary ammonium salts.

From the viewpoint of detergency and foaming property, the surfactant in the invention is particularly preferably at least one surfactant selected from the following (I) to (VI):

(I) an alkyl or alkenyl sulfate having a C8 to C20 alkyl or alkenyl group;

(II) a linear alkyl benzene sulfonate having a C10 to C14 alkyl group;

(III) a polyoxyethylene alkyl or alkenyl ether sulfate having a C8 to C18, preferably C10 to C16, alkyl or alkenyl group, wherein the average number of EO units added is 1 to 8, preferably 1 to 6;

(IV) an alkyl glycoside represented by the following formula (6):

$$R^{30}(OR^{31})_xG_y \quad (6)$$

wherein $R^{30}$ represents a C8 to C18 linear or branched alkyl or alkenyl group or an alkyl (C1 to C6) phenyl group, $R^{31}$ represents a C2 to C4 alkylene group, G represents a residue derived from a reducing sugar having 5 to 6 carbon atoms, preferably glucose residue, x represents a number of 0 to 5 on the average, and y represents a number of 1 to 10 on the average;

(V) an alkylamine oxide represented by the following formula (7):

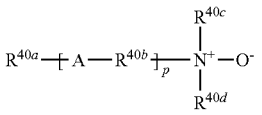

(7)

wherein $R^{40a}$ is a C8 to C16, preferably C10 to C16, more preferably C10 to C14, linear alkyl or alkenyl group, each of $R^{40c}$ and $R^{40d}$ is a C1 to C3 alkyl or hydroxyalkyl group, preferably a methyl group, an ethyl group or a hydroxyethyl group; $R^{40b}$ is a C1 to C5, preferably C2 or C3, alkylene group; A is a group selected from —COO—, —CONH—, OCO—, —NHCO—, and —O—, and p is a number of 0 or 1; and (VI) a betaine-based amphoteric surfactant represented by the following formula (8):

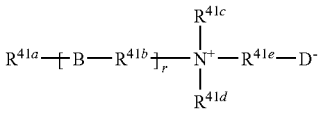

(8)

wherein $R^{41a}$ is a C9 to C23, preferably C9 to C17, more preferably C9 to C15, alkyl or alkenyl group, $R^{41b}$ is a C1 to C6, preferably C2 or C3, alkylene group; B is a group selected from —COO—, —CONH—, —OCO—, —NHCO—, and —O—, r is a number of 0 or 1; each of $R^{41c}$ and $R^{41d}$ is a C1 to C3 alkyl or hydroxyalkyl group, $R^{41e}$ is a C1 to C5, preferably C1 to C3, alkylene group optionally substituted with a hydroxy group; and D is a group selected from $—COO^-$, $—SO_3^-$, and $—OSO_3^-$.

<Detergent Composition for Hard Surface>

In the detergent composition for hard surface in the present invention, the total content of the components (A) and (B) ((A)+(B)) is 1 to 15% by mass, preferably 2 to 12% by mass, more preferably 3 to 10% by mass. The mass ratio of the component (A) to the component (B) ((A)/(B)) is 0.2 to 5.0, preferably 0.5 to 4.5. With these ranges given, excellent detergency can be obtained. While these ranges are satisfied, the content of the component (A) in the composition is preferably 1 to 10% by mass, more preferably 2 to 8% by mass, and the content of the component (B) in the composition is preferably 1 to 10% by mass, more preferably 2 to 6% by mass.

In the detergent composition for hard surface in the present invention, the total content of the component (C) and the component (D) ((C)+(D)) is 2 to 7% by mass, preferably 3 to 6% by mass. The mass ratio of the component (C) to the component (D) ((C)/(D)) is 5 to 30, preferably 10 to 25, more preferably 12 to 20. In calculating these values, a value calculated as acid form is used as the amount of the component (D). While these ranges are satisfied, the content of the component (C) in the composition is preferably 1 to 6% by mass, more preferably 2 to 5% by mass, and the content of the component (D) in the composition is preferably 0.07 to 21 by mass, more preferably 0.1 to 1% by mass.

The component (C) is known as an alkali used in a liquid detergent, and the component (D) is also known to be incorporated as a sequestering agent into a detergent. Usually, the amine as component (C) is incorporated into a liquid detergent thereby increasing the alkalinity of the detergent and contributing to improvement in detergency. The present invention is to propose pH in such a range as to be easily usable in daily use, and thus this object can be originally achieved by reducing the component (C) incorporated. However, a reduction in the component (C) leads to a deterioration in detergency, thus resulting in failure to achieve excellent detergency. The present inventors found that its cause is attributable to dirt-derived acid generated at the time of cleaning, and that this dirt-derived acid reduces the pH of the detergent rapidly to deteriorate detergency. Based on this finding, the present inventors, who dared to increase the amount of the amine incorporated as component (C), conceived that the polyvalent carboxylic acid as component (D) or a combination of salts thereof is used to achieve such pH as to be easily usable in daily use, thereby suppressing the fluctuation in pH by the dirt-derived acid, and they arrived at the conditions of the components (C) and (D) as described above.

In the detergent composition of the present invention, the content of the surfactant as component (E) is 0.1 to 5% by mass, and for conferring sufficient detergency and in consideration of economic efficiency, the content of the surfactant is preferably 0.2 to 3% by mass, more preferably 0.5 to 2% by mass.

Among the foregoing (I) to (VI), at least one of (IV) and (V) is preferably contained as the component (E) in the present invention, that is, surfactants selected from (IV) and/or (V) are preferably contained, and the total content thereof in the composition is preferably not less than 0.1% by mass, more preferably 0.1 to 2% by mass. Particularly, it is even more preferable that a surfactant from (IV) is contained in an amount of 0.01 to 1% by mass based on the composition and a surfactant from (V) is contained in an amount of 0.1 to 1% by mass based on the composition.

In the present invention, the content of the anionic surfactant is expressed in % by mass calculated in the form of acid. Polyoxyalkylene alkyl ether having an alkyl group having 8 or more carbon atoms is preferably not incorporated in an amount of 1% by mass or more into the composition.

From the viewpoint of detergency and alkalinity in use, the pH at 20° C. of the detergent composition for hard surface in the present invention is 9.5 to 11.5, preferably 10.0 to 11.0. The pH may be adjusted with the components (C) and (D) only or together with other acids or alkalis including sodium hydroxide, potassium hydroxide, sodium bicarbonate, potassium bicarbonate, sodium carbonate, potassium carbonate, hydrochloric acid, sulfuric acid, nitric acid and fatty acid.

The detergent composition for hard surface in the present invention is a liquid, the balance being water. Water used is preferably deionized water from which trace amounts of components such as metals, or hardness components in the case of high hardness, have been removed. The content of water in the composition is preferably 80 to 97% by mass, more preferably 85 to 92% by mass.

<Other Components>

The detergent composition for hard surface in the present invention may be compounded with a solvent to such an extent that the surface of an object is not influenced. The solvent can include a C2 to C6 polyhydric alcohol [referred to hereinafter as component (F)] other than the component (A).

The component (F) in the present invention is a polyhydric alcohol having 2 to 6 carbon atoms, preferably 2 to 5 carbon atoms, more preferably 2 to 4 carbon atoms. The polyhydric alcohol preferably has a structure wherein hydrogen atoms of a hydrocarbon or ether compound having carbon atoms whose number is described above have been substituted with hydroxyl groups. The number of hydroxyl groups in the polyhydric alcohol is preferably 2 or 3. As the chain length of the polyhydric alcohol is increased, the effect is lowered, and therefore, triethylene glycol is preferably not used. The component (F) can include the following components:

(F1) Dihydric Alcohol

Ethylene glycol, propylene glycol, butane diol, pentane diol, diethylene glycol, hexane diol, and dipropylene glycol.

(F2) Trihydric Alcohol

Glycerin and trihydroxy methyl ethane.

(F3) Tetrahydric or More Alcohol

Erythritol (tetrahydric), xylitol (pentahydric), and sorbitol (hexahydric).

Among these compounds, polyhydric alcohols selected from the groups (F1) and (F2) are preferable, and from the viewpoint of detergency etc., ethylene glycol, 1,2-butanediol, 1,6-hexanediol, and propylene glycol are preferable. Glycerin not only exhibits both effects with a good balance but is also easily usable from the viewpoint of economic efficiency, safety, and liquid stability, and is thus preferable. The component (F) is contained in an amount of preferably 0.5 to 5% by mass, more preferably 1 to 3% by mass, based on the composition, and from the viewpoint of detergency, (F)/[(A)+(B)] (ratio by mass) is preferably 3 or less.

A C2 or C3 monohydric alcohol [referred to hereinafter as component (G)] specifically ethanol or isopropanol, is a solvent incorporated often into a liquid detergent. In the present invention, however, its content is preferably less than 1% by mass, more preferably 0.001 to 0.1% by mass, based on the composition, in order to prevent deterioration in the detergency of the components (A) and (B).

In addition to the components described above, components known to be incorporated into household detergents, for example, hydrotrops such as p-toluene sulfonic acid, xylene sulfonic acid and salts thereof, dispersants such as polyacrylic acid and salts thereof, antioxidants such as BHT, thickening agents, perfumes, dyes, pigments and preservatives may be added to the detergent composition for hard surface in the present invention in such a range that the effect of the present invention is not deteriorated.

The detergent composition for hard surface in the present invention may be used by spraying, as liquid or foam, onto the surface of an object. Alternatively it may be used as foam having an improved foaming property and an improved adhesion to a wall surface with a foam structure being hardly broken. The detergent composition may be used by impregnating a sheet such as nonwoven cloth, woven cloth or paper therewith. When the detergent composition is formed into aerosol for spraying, it should be dispersed in a propellant, and the component (E) should be selected in consideration of compatibility with a propellant. The composition of the present invention is preferably a detergent contained in a spray container provided with a spraying means, and the container is preferably provided with a trigger-type sprayer. The container is preferably a highly light-shielding container, and a colored transparent container may also be used insofar as it does not discolor or denature the detergent composition.

The viscosity of the detergent composition for hard surface in the present invention, when subjected particularly to spray application, is preferably 1 to 10 mPa·s. This viscosity is measured by a Brookfield viscometer (manufactured by TOIMEC) after stirring at 60 rpm for 1 minute under the condition of 20° C. with Rotor No. 1.

Example

The following examples are for explaining the embodiments of the present invention. These examples are for exemplifying the present invention and are not intended to be limiting of the present invention.

A liquid detergent composition shown in Table 1 was prepared and evaluated as follows. The liquid detergent composition was charged into a trigger-type sprayer container and used in the following evaluation. This trigger-type sprayer container had been made free from its content (Magic Rin, marketed in March, 2006, manufactured by Kao Corporation), then sufficiently washed with deionized water, dried and used in this evaluation.

The pH was regulated finally with hydrochloric acid and sodium hydroxide.

<Evaluation Method>

10 g tempura oil was applied uniformly onto an iron plate, then burned at a temperature of 180° C. for 30 minutes and left at room temperature for 3 months thereby forming an almost dried film, and this iron plate was used as a model polluted plate. About 0.5 ml of the liquid detergent composition was sprayed onto the horizontally fixed model polluted plate and then left for 1 minute. Thereafter, the dirt rising to the surface was removed lightly with absorbent cotton. Twenty different polluted plates were subjected to this operation, and the degrees of cleaning of the respective plates were visually checked and evaluated under the following criteria, and expressed as the average in 20 evaluations. The results are shown in Table 1.

5: Complete removal of the dirt.
4: Removal of 60 to 80% of the dirt.
3: Removal of 50 to 60% of the dirt.
2: Removal of 30 to 50% of the dirt.
1: Removal of up to 30% of the dirt.
0: No removal of the dirt.

TABLE 1

| | | | | Example | | | | | | | |
|---|---|---|---|---|---|---|---|---|---|---|---|
| | | | | 1 | 2 | 3 | 4 | 5 | 6 | 7 | 8 |
| Liquid detergent composition | Compounding component (mass %) | (A) | Mono-normal amyl glyceryl ether | 3 | 2 | 3 | 3 | 2 | 1 | 4 | 3 |
| | | | Mono-3-methyl butyl glyceryl ether | | | | | | | | |
| | | | Monohexyl glyceryl ether | | | | | | | | |
| | | | 2-Ethyl hexyl glyceryl ether | | 1 | | | | | | |

TABLE 1-continued

| | | | | | | | | | |
|---|---|---|---|---|---|---|---|---|---|
| (B) | Diethylene glycol monobutyl ether | 3 | 3 | 3 | 3 | 4 | 5 | 2 | 2 |
| | Dipropylene glycol monobutyl ether | | | | | | | | 2 |
| (C) | Monoethanol amine | 3 | 3 | 3 | 3 | 3 | 3 | 3 | 3 |
| (D) | Citric acid | 0.2 | 0.2 | 0.2 | 0.1 | 0.2 | 0.2 | 0.2 | 0.2 |
| (E) | AO | 1 | 1 | 1 | 1 | 1 | 1 | 1 | 1 |
| | APAO | | | | | | | | |
| | AG (1) | | | | | | | | |
| | AG (2) | | | | | | | | |
| | Glycerine | | | 1 | | | | | |
| | Water | Balance | Balance | Balance | Balance | Balance | Balance | Balance | Balance |
| | Total | 100 | 100 | 100 | 100 | 100 | 100 | 100 | 100 |
| | pH (20° C.) | 11 | 11 | 11 | 11 | 11 | 11 | 11 | 11 |
| | (A) + (B) (mass %) | 6 | 6 | 6 | 6 | 6 | 6 | 6 | 7 |
| | (A)/(B) (mass ratio) | 1.0 | 1.0 | 1.0 | 1.0 | 0.5 | 0.2 | 2.0 | 0.8 |
| | (C) + (D) (mass %) | 3.2 | 3.2 | 3.2 | 3.1 | 3.2 | 3.2 | 3.2 | 3.2 |
| | (C)/(D) (mass ratio) | 15 | 15 | 15 | 30 | 15 | 15 | 15 | 15 |
| | Detergency for denatured oil dirt | 4.6 | 4.0 | 4.7 | 4.3 | 4.3 | 4.0 | 4.7 | 4.7 |

| | | | | Example | | | | | | |
|---|---|---|---|---|---|---|---|---|---|---|
| | | | | 9 | 10 | 11 | 12 | 13 | 14 | 15 |
| Liquid detergent composition | Compounding component (mass %) | (A) | Mono-normal amyl glyceryl ether | 3 | 5 | 2 | 2 | 2 | 3 | 3 |
| | | | Mono-3-methyl butyl glyceryl ether | | | 1 | | | | |
| | | | Monohexyl glyceryl ether | | | | 3 | 3 | | |
| | | | 2-Ethyl hexyl glyceryl ether | | | | | | | |
| | | (B) | Diethylene glycol monobutyl ether | 2 | 5 | 3 | 5 | 5 | 3 | 2 |
| | | | Dipropylene glycol monobutyl ether | 2 | | | | | | 2 |
| | | (C) | Monoethanol amine | 3 | 5 | 3 | 5 | 5 | 3 | 3 |
| | | (D) | Citric acid | 0.2 | 0.4 | 0.2 | 0.4 | 1 | 0.2 | 0.2 |
| | | (E) | AO | 0.5 | 2 | 1 | 2 | 2 | | 0.5 |
| | | | APAO | | | | | | 1 | |
| | | | AG (1) | | | | | | | 0.5 |
| | | | AG (2) | 0.5 | | | | | | |
| | | | Glycerine | | | | | | | |
| | | | Water | Balance | Balance | Balance | Balance | Balance | Balance | Balance |
| | | | Total | 100 | 100 | 100 | 100 | 100 | 100 | 100 |
| | | | pH (20° C.) | 11 | 10.5 | 11 | 10.5 | 9.7 | 11 | 11 |
| | | | (A) + (B) (mass %) | 7 | 10 | 6 | 10 | 10 | 6 | 7 |
| | | | (A)/(B) (mass ratio) | 0.8 | 1.0 | 1.0 | 1.0 | 1.0 | 1.0 | 0.8 |
| | | | (C) + (D) (mass %) | 3.2 | 5.4 | 3.2 | 5.4 | 6 | 3.2 | 3.2 |
| | | | (C)/(D) (mass ratio) | 15 | 12.5 | 15 | 12.5 | 5 | 15 | 15 |
| | | | Detergency for denatured oil dirt | 4.8 | 4.7 | 4.9 | 4.7 | 4.3 | 4.5 | 4.8 |

TABLE 2

| | | | | Comparative example | | | | | | | |
|---|---|---|---|---|---|---|---|---|---|---|---|
| | | | | 1 | 2 | 3 | 4 | 5 | 6 | 7 | 8 |
| Liquid detergent composition | Compounding component (mass %) | (A) | Mono-normal amyl glyceryl ether | 3 | 3 | 3 | 3 | 3 | | 1 | |
| | | | Monohexyl glyceryl ether | | | | | | | | |
| | | | 2-Ethyl hexyl glyceryl ether | | | | | | | | 5.5 |
| | | (B) | Diethylene glycol monobutyl ether | 3 | 3 | 3 | 3 | 3 | 6 | 8 | 0.5 |
| | | | Dipropylene glycol monobutyl ether | | | | | | | | |
| | | (C) | Monoethanol amine | 3 | | 3 | 3 | 3 | 3 | 5 | 5 |
| | | (D) | Citiric acid | | 0.2 | 1.5 | 0.08 | 0.2 | 0.2 | 1 | 1 |
| | | (E) | AO | 1 | 1 | 1 | 1 | | 1 | 2 | 2 |
| | | | AG (2) | | | | | | | | |
| | | | Water | Balance | Balance | Balance | Balance | Balance | Balance | Balance | Balance |
| | | | Total | 100 | 101 | 100 | 100 | 100 | 100 | 100 | 100 |
| | | | pH (20° C.) | 11 | 11 | 9.2 | 11 | 11 | 11 | 10.5 | 10.5 |
| | | | (A) + (B) (mass %) | 6 | 6 | 6 | 9.5 | 9.6 | 6 | 9 | 6 |

TABLE 2-continued

| | Comparative example | | | | | | | |
|---|---|---|---|---|---|---|---|---|
| | 1 | 2 | 3 | 4 | 5 | 6 | 7 | 8 |
| (A)/(B) (mass ratio) | 1.00 | 1.00 | 1.00 | 1.00 | 1.00 | — | 0.13 | 11.00 |
| (C) + (D) (mass %) | 3 | 0.2 | 4.5 | 3.3 | 3.4 | 3.2 | 6 | 6 |
| (C)/(D) (mass ratio) | — | — | 2 | 37.5 | 15 | 15 | 5 | 5 |
| Detergency for denatured oil dirt | 2.5 | 1.8 | 2.0 | 2.7 | 1.5 | 2.5 | 3.0 | 2.1 |

Note: The symbols in the tables are as follows:
AO: lauryl dimethyl amine oxide
APAO: lauryl amide propyl amine oxide
AG (1): alkyl glycoside (with C12 and C14 alkyl groups; the average degree of condensation of glucose sugars, 1.35)
AG (2): lauryl glucoside

The invention claimed is:

1. A detergent composition for hard surface, comprising:

(A) a monoalkyl glyceryl ether whose alkyl group has 3 to 8 carbon atoms, (B) a compound represented by the following formula (1):

$$R^1(OR^2)_mOH \quad (1)$$

wherein $R^1$ is a C2 to C6 alkyl group, m is a number of 1 to 4, and $R^2$ is a C2 or C3 alkylene group, (C) monoethanolamine, (D) citric acid, 0.1 to 5% by mass of (E) at least one surfactant selected from the group consisting of the following (IV) to (V):

(IV) an alkyl glycoside represented by the following formula (6):

$$R^{30}(OR^{31})_xG_y \quad (6)$$

wherein $R^{30}$ represents a C8 to C18 linear or branched alkyl or alkenyl group or an alkyl (C1 to C6) phenyl group, $R^{31}$ represents a C2 to C4 alkylene group, G represents a residue derived from a reducing sugar having 5 to 6 carbon atoms, x represents a number of 0 to 5 on the average, and y represents a number of 1 to 10 on the average;

(V) an alkylamine oxide represented by the following formula (7):

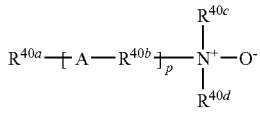

(7)

wherein $R^{40a}$ represents a C8 to C16 linear alkyl or alkenyl group, $R^{40c}$ and $R^{40d}$ each represent a C1 to C3 alkyl or hydroxyalkyl group; $R^{40b}$ represents a C1 to C5 alkylene group; A represents a group selected from the group consisting of —COO—, —CONH—, —OCO—, —NHCO—, and —O—, and p is a number of 0 or 1; and water, wherein:

the mass ratio of (A) to (B) is (A)/(B)=0.2 to 5, the total content of (A) and (B) is (A)+(B)=1 to 15% by mass, the mass ratio of (C) to (D) is (C)/(D)=5 to 30, the total content of (C) and (D) is (C)+(D)=2 to 7% by mass, provided that (D) is calculated as acid form, and the pH of the detergent composition at 20° C. is 9.5 to 11.5.

* * * * *